US007530715B2

(12) United States Patent
Mii

(10) Patent No.: US 7,530,715 B2
(45) Date of Patent: May 12, 2009

(54) LUMINESCENT ASSEMBLY WITH SHORTWAVE AND VISIBLE LIGHT SOURCE

(76) Inventor: Jenn-Wei Mii, 18 F., No. 108, Section 1, Hsin-Tai-Wu Rd., Hsichih City, Taipei Hsien (TW)

( * ) Notice: Subject to any disclaimer, the term of this patent is extended or adjusted under 35 U.S.C. 154(b) by 191 days.

(21) Appl. No.: 11/443,147

(22) Filed: May 31, 2006

(65) Prior Publication Data

US 2008/0049421 A1 Feb. 28, 2008

(51) Int. Cl.
*H01J 63/04* (2006.01)

(52) U.S. Cl. ..... 362/293; 362/260; 362/84; 362/310; 313/489; 313/485

(58) Field of Classification Search ..... 362/84, 362/223, 260, 293, 310; 313/485, 489
See application file for complete search history.

(56) References Cited

U.S. PATENT DOCUMENTS

| | | | | | |
|---|---|---|---|---|---|
| 2,135,480 | A | * | 11/1938 | Birdseye | 313/113 |
| 2,337,745 | A | * | 12/1943 | Garstang | 362/260 |
| 3,225,241 | A | * | 12/1965 | Eberle et al. | 313/489 |
| 3,504,819 | A | * | 4/1970 | Veres | 313/485 |
| 4,061,946 | A | * | 12/1977 | Schreurs | 313/489 |
| 4,766,526 | A | | 8/1988 | Morimoto et al. | |
| 5,053,933 | A | * | 10/1991 | Imris | 362/260 |
| 5,079,681 | A | * | 1/1992 | Baba et al. | 362/260 |
| 5,329,435 | A | * | 7/1994 | McGuire | 362/293 |
| 5,903,095 | A | * | 5/1999 | Yoshida et al. | 313/485 |
| 6,120,160 | A | * | 9/2000 | Nakagawa | 362/293 |
| 2004/0012959 | A1 | * | 1/2004 | Robertson et al. | 362/223 |
| 2004/0145895 | A1 | | 7/2004 | Ouderkirk | |
| 2004/0257797 | A1 | | 12/2004 | Suehiro | |

FOREIGN PATENT DOCUMENTS

| | | | | |
|---|---|---|---|---|
| EP | 1 111 026 | | | 6/2001 |
| JP | 61-31923 | | | 7/1986 |
| JP | 61-144562 | | | 9/1986 |
| JP | 62-17904 | | | 1/1987 |
| JP | 62-167361 | | | 10/1987 |
| JP | 64-065767 | | | 3/1989 |
| JP | 01209631 | A | * | 8/1989 |
| JP | 04-303548 | | | 10/1992 |
| JP | 05211001 | A | * | 8/1993 |
| JP | 10-283999 | | | 10/1998 |
| JP | 2002 067152 | | | 3/2002 |
| JP | 2002-184357 | | | 6/2002 |
| JP | 2002-237277 | | | 8/2002 |
| JP | 2004-018966 | | | 1/2004 |
| JP | 2005 251425 | | | 9/2005 |

* cited by examiner

*Primary Examiner*—Ismael Negron
(74) *Attorney, Agent, or Firm*—Bacon & Thomas, PLLC.

(57) ABSTRACT

A luminescent assembly has a housing, at least one shortwave light source, at least one shortwave light reflecting cover and a primary visible light source. The shortwave light source is mounted with the housing and emits shortwave light when electricity is applied to the shortwave light source. The shortwave light reflecting cover covers part of the shortwave light source. The primary visible light source, which is significantly larger than the shortwave light source, is a fluorescent/phosphorescent coating formed on part of the housing opposed to the shortwave light cover, and emits visible light when shortwave light is irradiated from the shortwave light source and reflected by the shortwave light reflecting cover.

46 Claims, 24 Drawing Sheets

LUMINESCENT ASSEMBLY WITH SHORTWAVE AND VISIBLE LIGHT SOURCE

BACKGROUND OF THE INVENTION

1. Field of Invention

The present invention relates to a luminescent assembly, and more particularly to a luminescent assembly with an increased brightness.

2. Description of the Related Art

A conventional luminescent apparatus such as a fluorescent light, light-emitting diode or the like has a luminescent intensity and a brightness that is determined by the luminescent intensity. Take the fluorescent light for example, this luminescent apparatus comprises a tube, a fluorescent coating, two electrodes and a noble gas and mercury vapor. The tube is vacuumed and has an inner surface, inner space, outer surface and two ends. The fluorescent agent is applied to or coats on the whole inner surface of the tube to form a fluorescent coating and has a thickness. The fluorescent coating has an outer surface and an inner surface. The inner surface is exposed to the inner space. The outer surface is in contact with the inner surface of the fluorescent tube. One electrode is mounted in the inner space at or near one end of the tube. The other electrode is mounted in the inner space at or near the opposite end of the tube. The noble gas and mercury vapor fill the inner space of the vacuumed tube. When electricity is applied to the electrodes, the negative electrode emits electrons that excite the noble gas and causes the mercury vapor to emit ultraviolet photons, which causes the fluorescent coating to emit visible light. The visible light passes through the fluorescent coating and the tube and is visible.

However, such fluorescent coating has the following shortcomings.

1. When the ultraviolet photons directly irradiate the fluorescent coating, the ultraviolet photons will excite the fluorescent coating that emits visible light. However, fewer ultraviolet photons penetrate the fluorescent coating to excite the outer surface of the fluorescent coating. Consequently, visible light created at the outer surface of the fluorescent coating will be weaker than that created at the inner surface.

2. The fluorescent coating is not a good translucent material and will decrease the percentage of visible light that passes through the fluorescent coating and cause the luminescent intensity of the visible light to be weak when it passes through the fluorescent coating to the outer surface.

The two characteristics result in reduced brightness and wasted electrical energy.

To solve the foregoing problems, the fluorescent coating may cover about only half of the inner side of the fluorescent tube, and other about half of the fluorescent tube is transparent. The ultraviolet photons irradiate the fluorescent coating on half of the inner side of the fluorescent tube, which emits visible light through the uncoated and transparent half of the fluorescent tube. However, ultraviolet photons will pass directly through the transparent half of the fluorescent tube and may damage the eyes and the skin of people exposed to the ultraviolet photons if the tube does not block the ultraviolet photons. Moreover, the ultraviolet photons that pass through the transparent half of the fluorescent tube do not irradiate the fluorescent coating, which significantly reduces the efficiency of the luminescent apparatus and waste electrical energy.

To overcome the shortcomings, the present invention provides a luminescent assembly with increased brightness to mitigate or obviate the aforementioned shortcomings.

SUMMARY OF THE INVENTION

The primary objective of the present invention is to provide a luminescent assembly with increased brightness in order to save electrical energy.

To achieve the objective, a luminescent assembly with increased brightness comprises a housing, a shortwave light source, a shortwave light cover and a primary visible light source. The shortwave light source is mounted with the housing and emits shortwave light when electricity is applied to the shortwave light source. The shortwave light cover covers part of the shortwave light source and is a fluorescent/phosphorescent coating or reflector that emits visible light or reflects shortwave light when irradiated by shortwave light from the shortwave light source. The primary visible light source is significantly larger than the shortwave light cover, is a fluorescent/phosphorescent coating, is formed on part of the housing and is opposite to the shortwave light cover, emits visible light when irradiated by shortwave light from the shortwave light source. Visible light emitted from and reflected by the primary visible light source passes around the shortwave light source so the luminescent assembly has increased brightness and less electrical power is required to achieve brightness equivalent to a conventional luminescent assembly. Furthermore, shortwave light emitted from the shortwave light source radiate to the shortwave light cover and the primary visible light source to emit visible light and does not pose a threat to people in the vicinity of the luminescent assembly.

Other objectives, advantages and novel features of the invention will become more apparent from the following detailed description when taken in conjunction with the accompanying drawings.

DETAILED DESCRIPTION OF THE INVENTION

Figure 1:
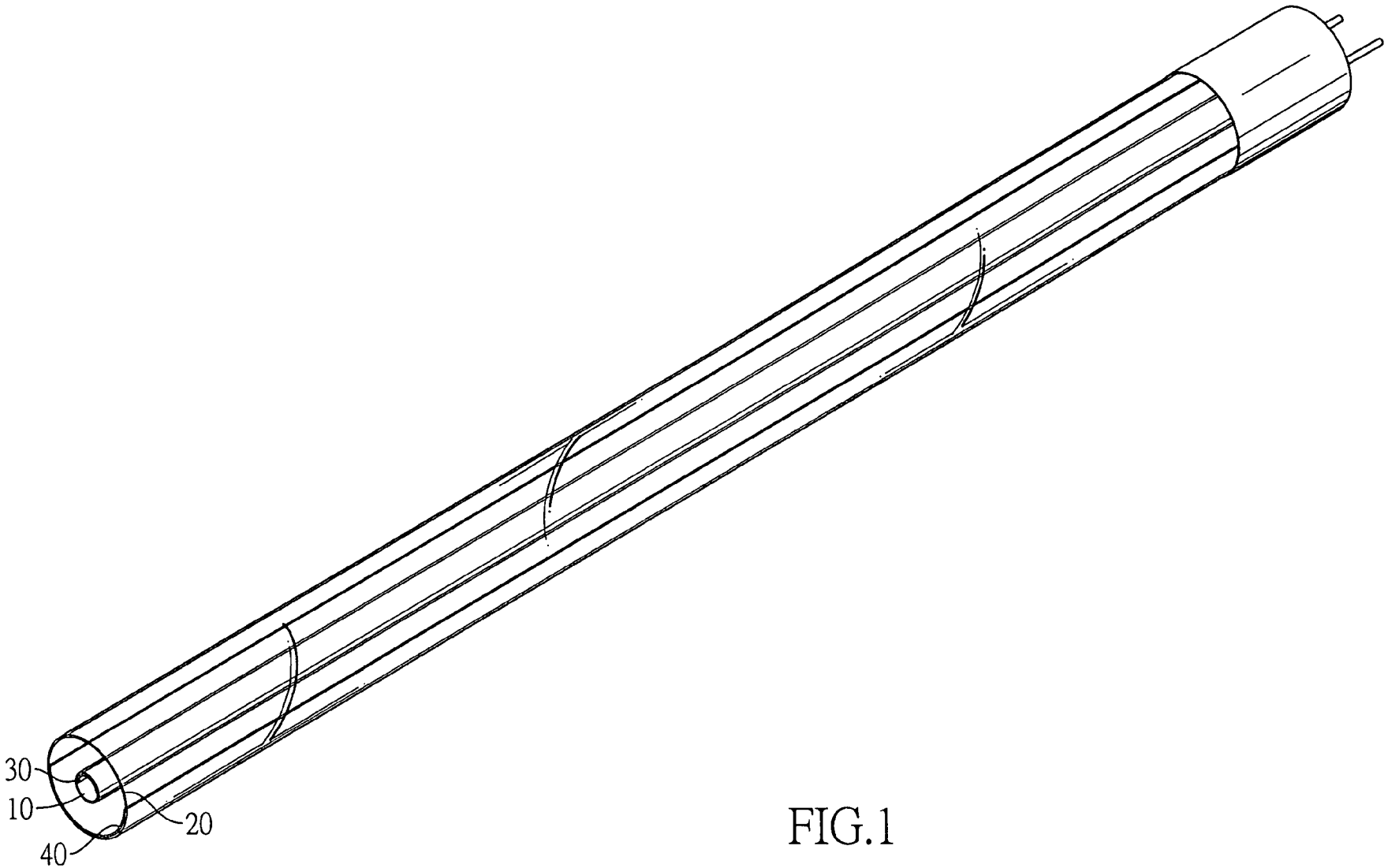
FIG. 1 is a cross sectional perspective view of a first embodiment of a luminescent assembly in accordance with the present invention with a circular shortwave light source.
Figure 2:
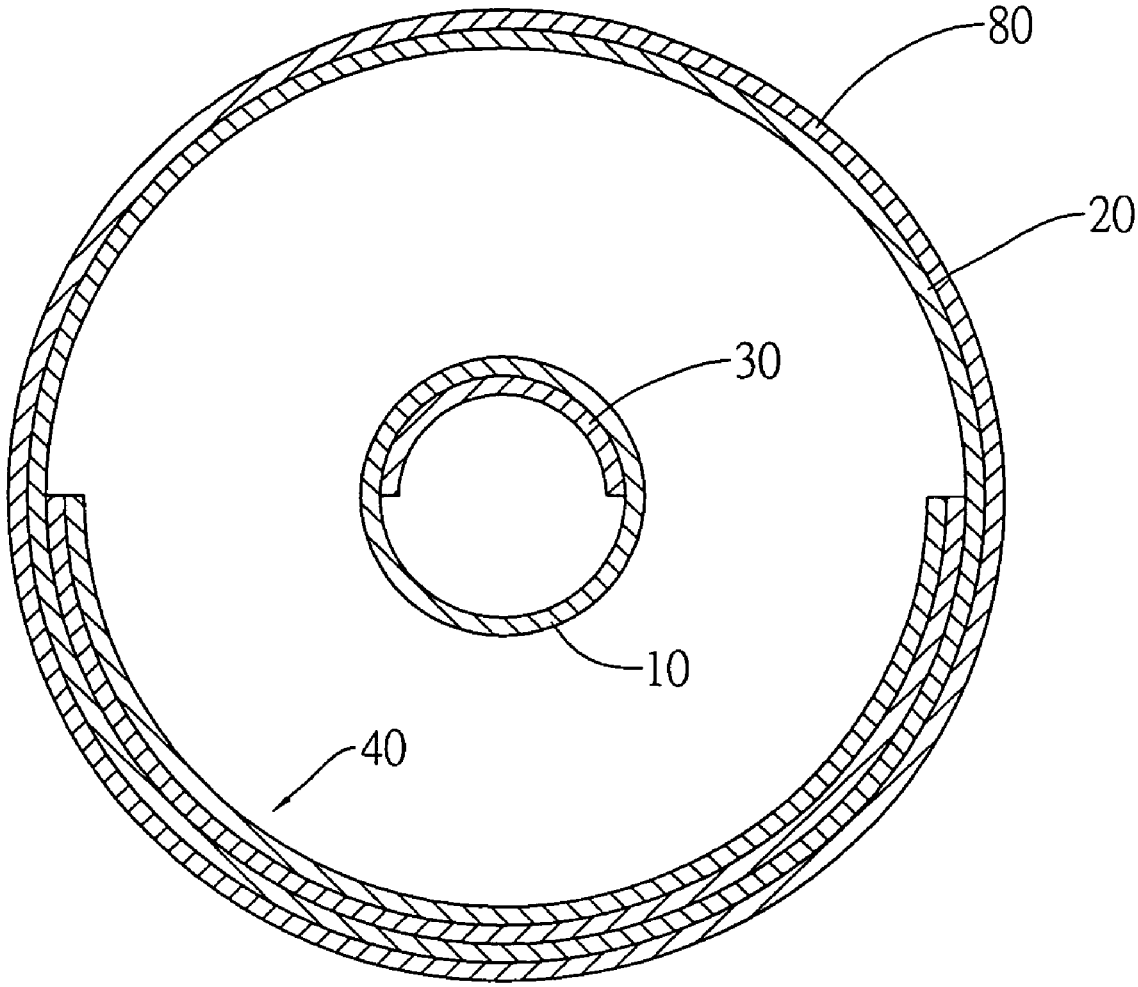
FIG. 2 is a cross sectional end view of the luminescent assembly in FIG. 1 with a shortwave light absorbing cover covering a housing.
Figure 3:
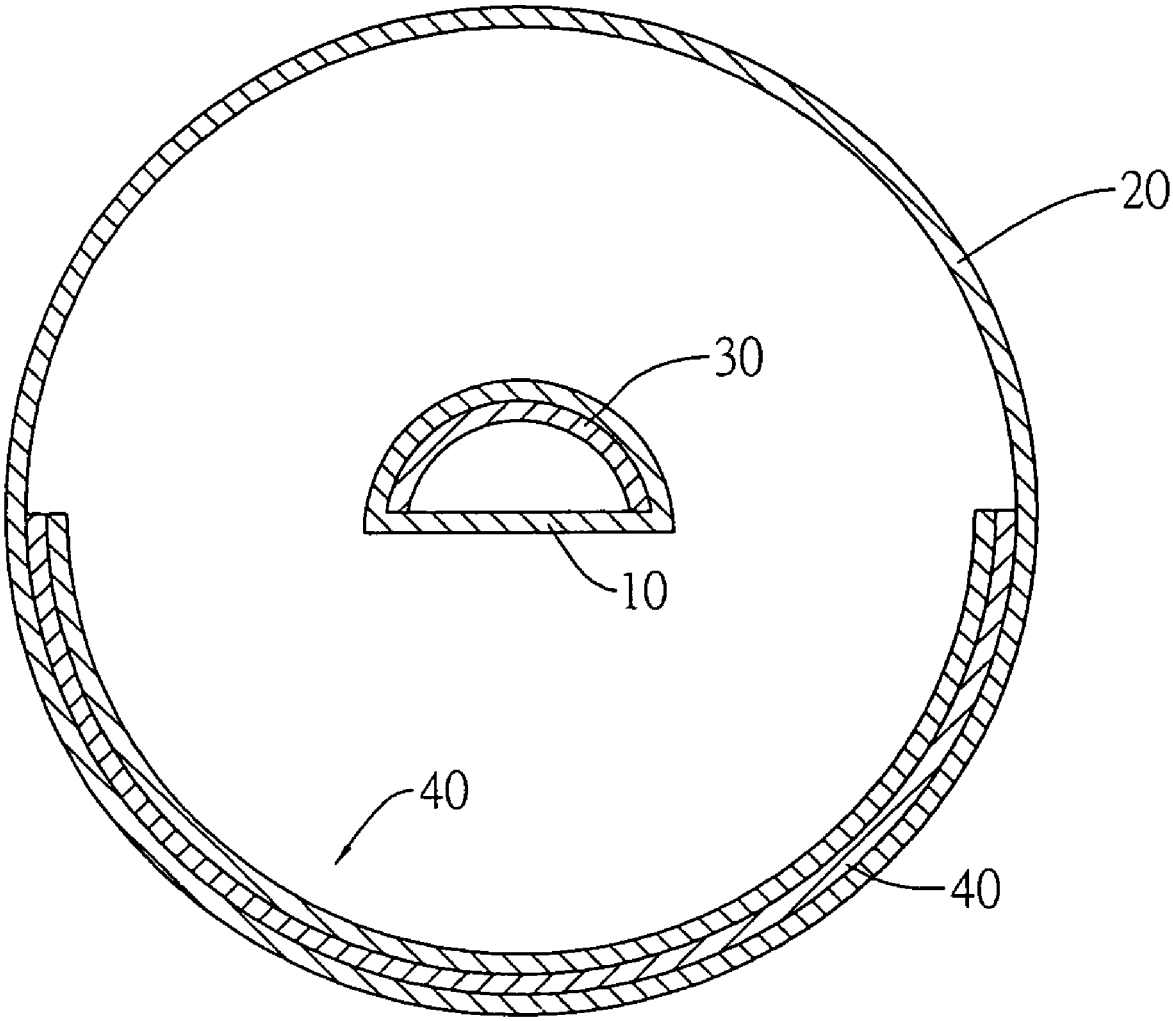
FIG. 3 is a cross sectional end view of the luminescent assembly in FIG. 1 with a semi-cylindrical shortwave light source.
Figure 4:
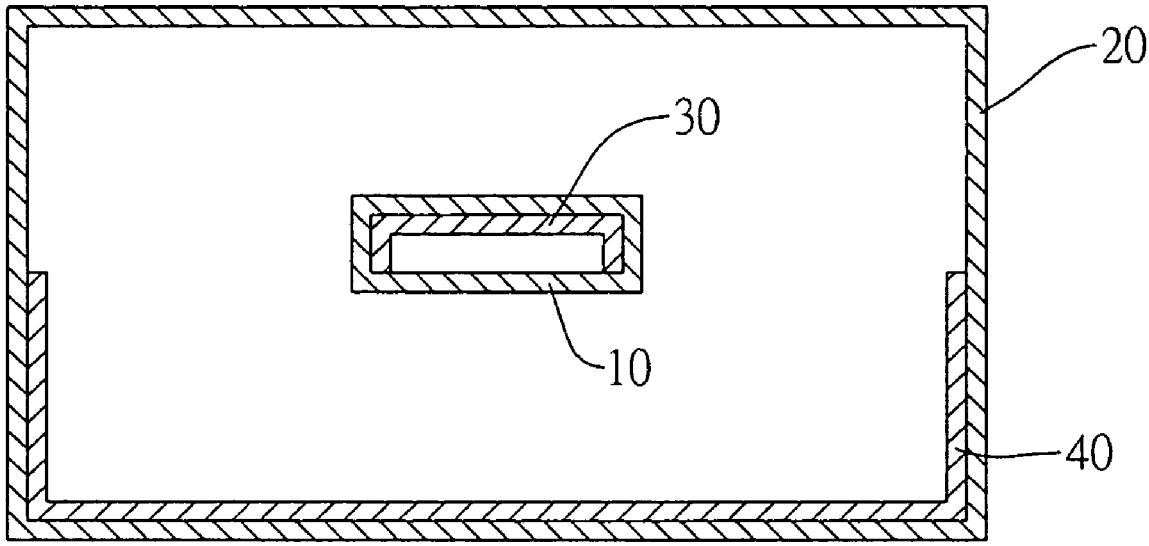
FIG. 4 is a cross sectional end view of the luminescent assembly in FIG. 1 having a shortwave light source and a housing with rectangular cross sections.
Figure 5:
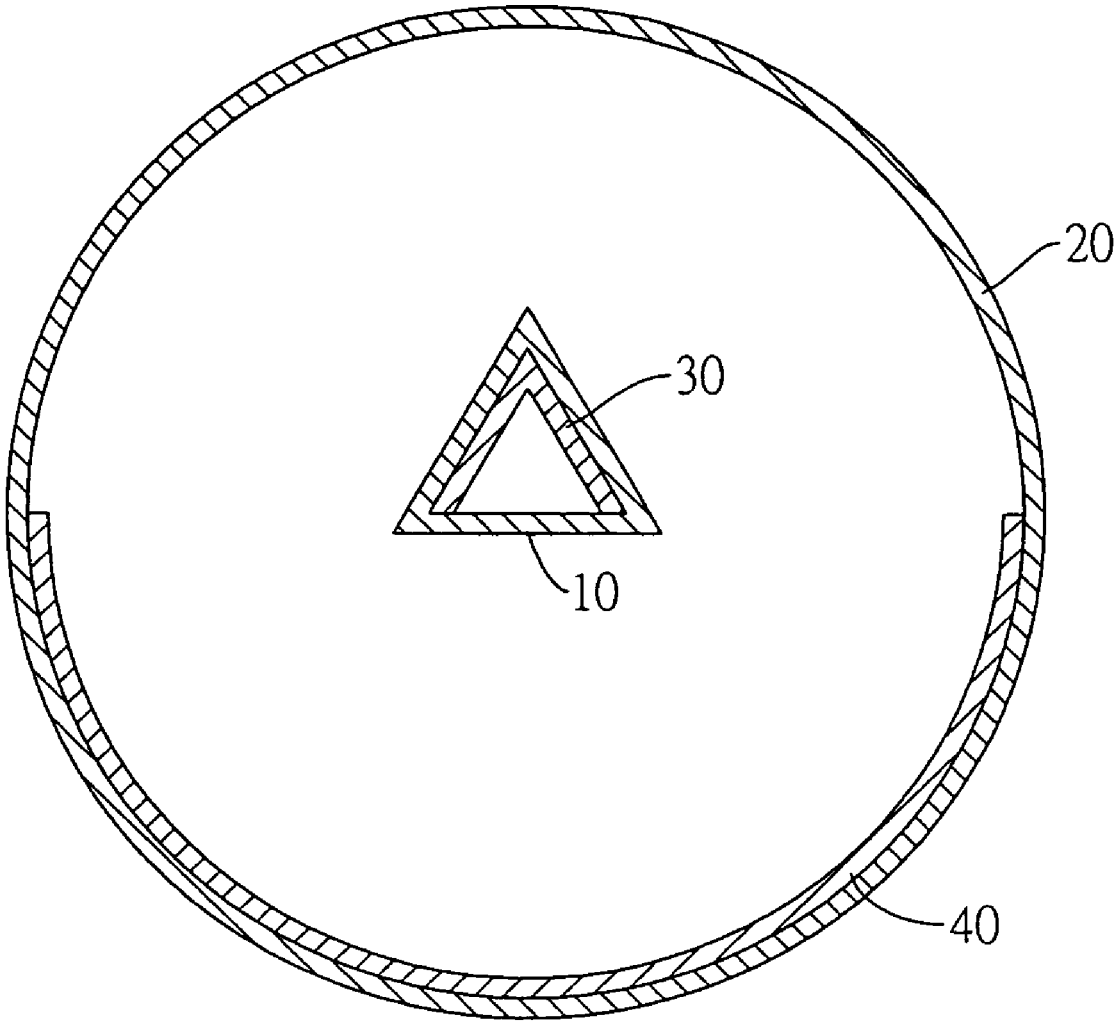
FIG. 5 is a cross sectional end view of the luminescent assembly in FIG. 1 having a shortwave light source with a triangular cross section.
Figure 6:
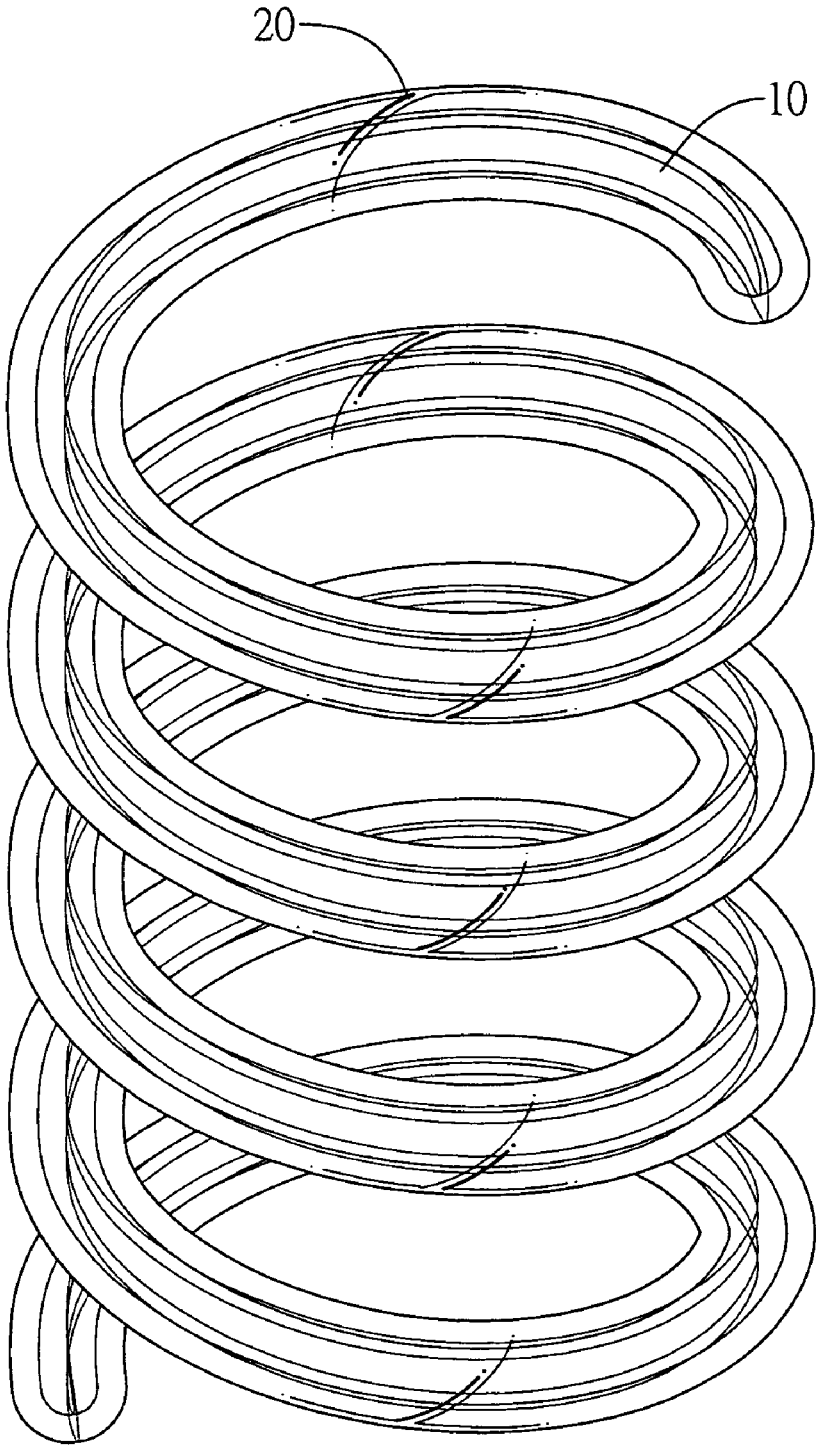
FIG. 6 is a perspective view of the luminescent assembly in FIG. 1 in a spiral configuration.
Figure 7:
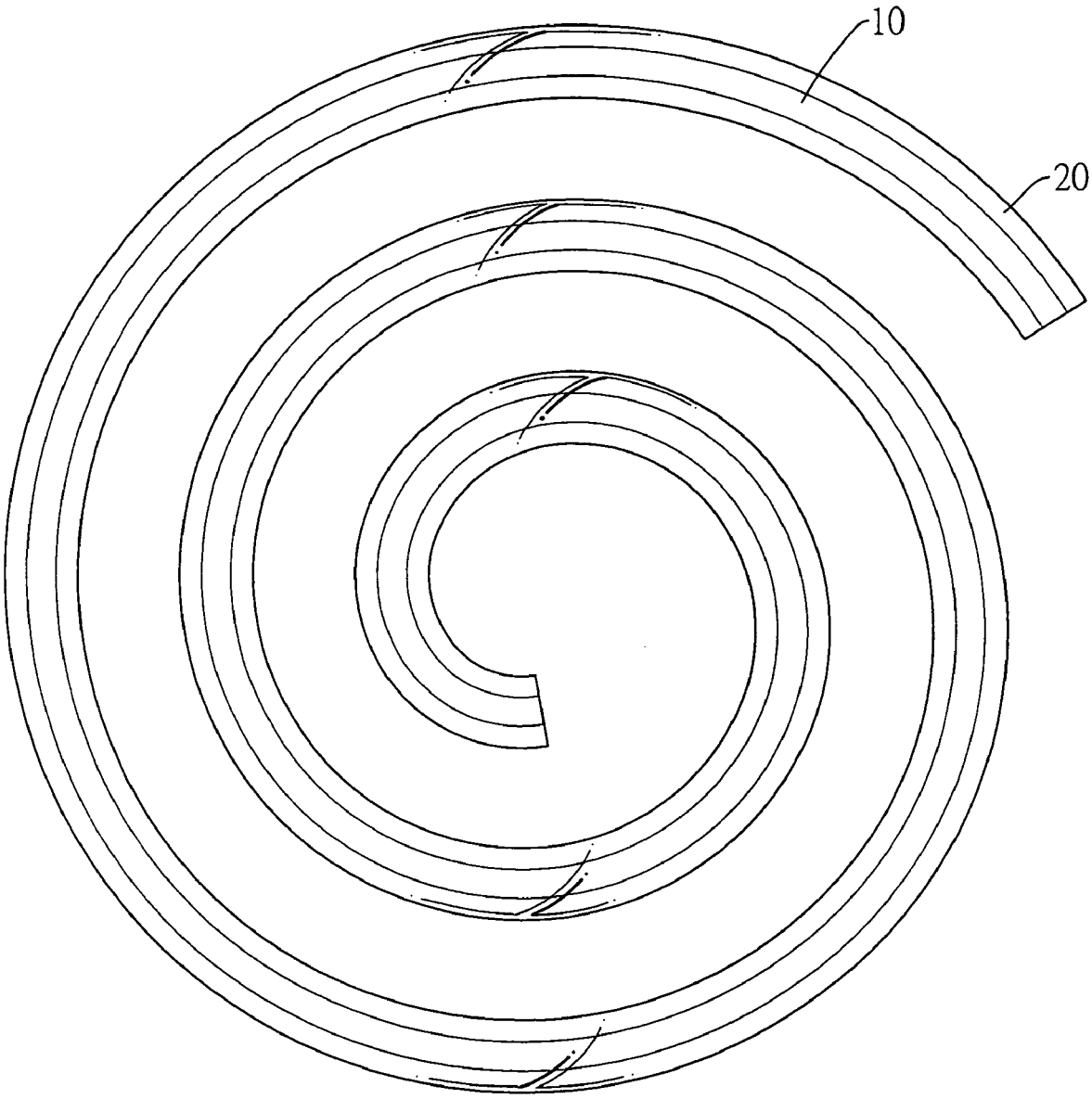
FIG. 7 is a top view of the luminescent assembly in FIG. 1 in another spiral configuration.
Figure 8:
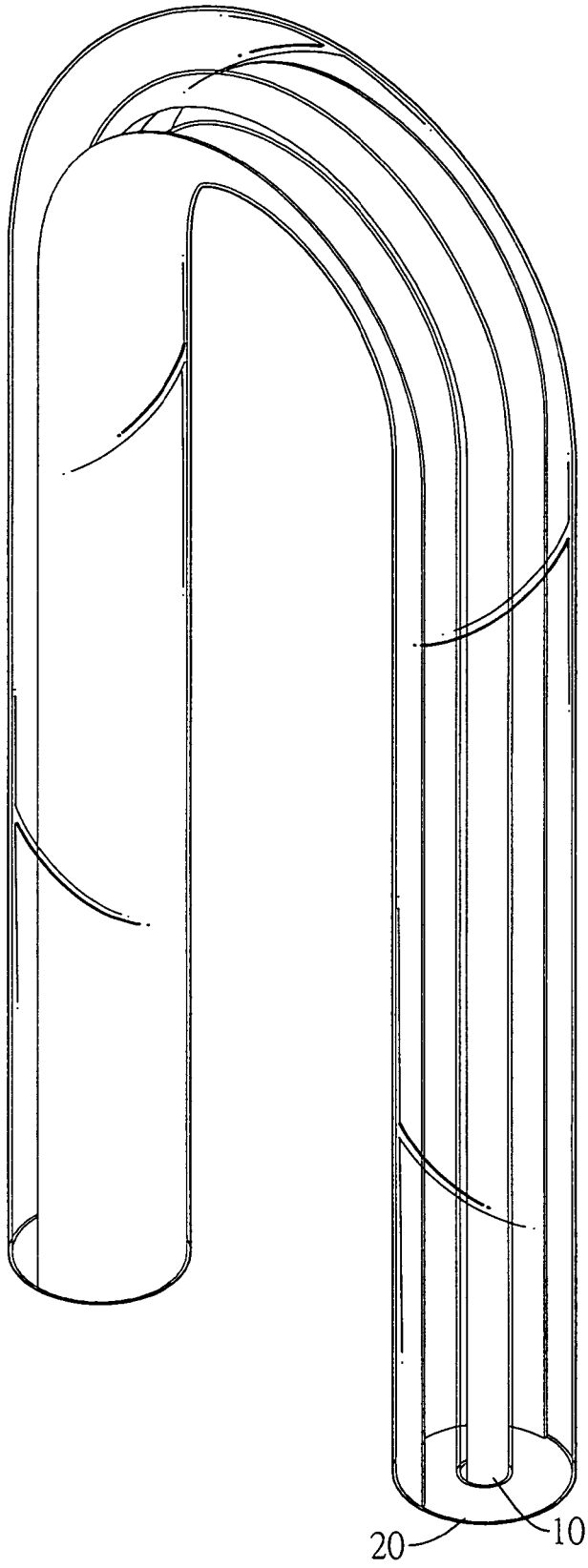
FIG. 8 is a perspective view of the luminescent assembly in FIG. 1 in a U-shaped configuration.
Figure 9:
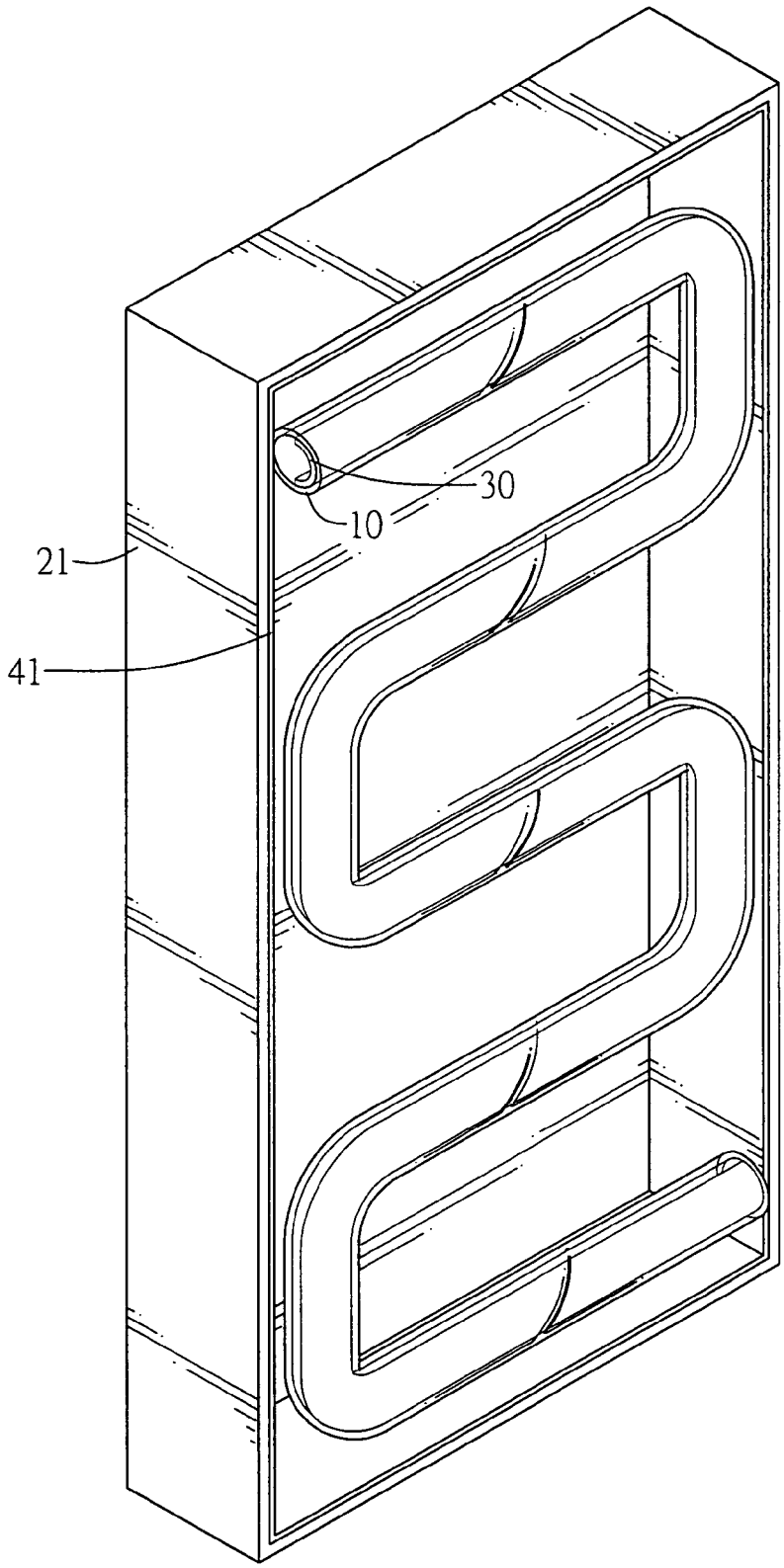
FIG. 9 is a perspective view in partial section of a second embodiment of a luminescent assembly in accordance with the present invention.
Figure 10:
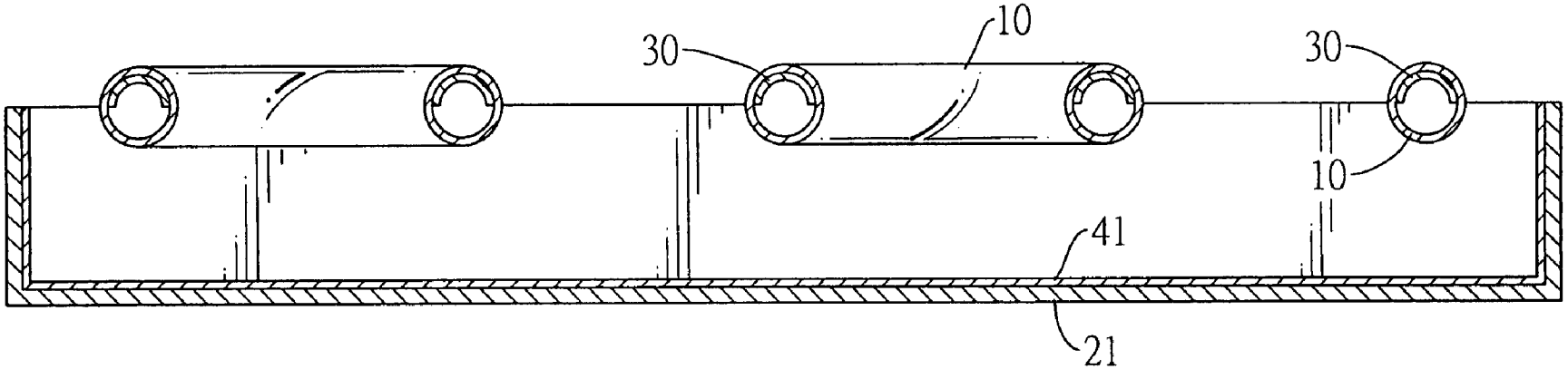
FIG. 10 is a cross sectional side view of the luminescent assembly in FIG. 9.

With reference to FIGS. 1, 11, 12, 13, 17, 18, 22 to 24, a luminescent assembly with increased brightness in accordance with the present invention comprises a housing (20, 21, 22, 23), at least one shortwave light source (10, 11, 12), at least one shortwave light cover (30, 31, 32), at least one optional electrode shields (50), a primary visible light source (40, 41, 42, 43) and an optional shortwave light absorbing cover (80).

The housing (20, 21, 22, 23, 24) may be implemented as a tube, a box, a concave substrate on an electrical lead, a transparent substrate or a combination of multiple transparent substrates. With further reference to FIGS. 4 to 9, the tubular housing (20) has a front surface, a rear surface, two ends and a cross section that may be circular or polygonal such as triangular, rectangular or the like, may be straight, annular, U-shaped, helical or the like, may have multiple bends and may be a quartz glass. The box housing (21) has an open or transparent face, a rear surface, two side surfaces and a longitudinal section. The longitudinal section may be circular, semicircular or polygonal. The concave housing (22) may be circular, semicircular, polygonal or oval-shaped and have an open face, a rear, an optional supporting substrate (60) and multiple optional lead frames (70). The supporting substrate (60) mounted in the concave housing (22) is transparent, may be a conductor or an electrode and has a cross section being semicircular, tetragonal or the like. The lead frames (70) connect with the concave housing (22). The transparent substrate housing (23) and the combination of multiple transparent substrate (24) is solid or hollow, has a front surface and a rear surface and a cross section that may be semicircular or polygonal such as triangular, rectangular or the like. The front surface may be flat.

The at least one shortwave light source (10, 11, 12) is mounted with the housing (20, 21, 22, 23), emits shortwave light, may be implemented as a tube and at least one chip and has a front. The shortwave light has a main emission peak. The main emission wavelength is set within a range from 200 nm to 400 nm for ultraviolet light and from 400 nm to 530 nm for blue light, so the shortwave light is ultraviolet light or blue light. With further reference to FIGS. 2, 3, 10, 11, 19 and 20, the tubular shortwave light source (10) have at least one end, an inner space, a front, a rear, an outer surface, an inner surface, two sides and at least one electrode and a cross section, may be mounted concentrically inside a tubular housing (20), at the open or transparent face of a box housing (21), a transparent substrate (23) or a combination of multiple transparent substrate (24). The inner space may have a transparent quartz glass bar occupies half of the inner space. The at least one electrode in the tubular shortwave light source (30) is mounted respectively in the at least one end. The tubular shortwave light source (10) may have a cross section that may be circular or polygonal such as triangular, rectangular or the like, may be straight, annular, U-shaped, helical or the like and may be made of a quartz glass.

The at least one chip is a light emitting diode (LED). The LED can be categorized to a SMD LED and a lamp type LED and at least one chip of the SMD LED or the lamp type LED is formed a SMD LED shortwave light source (12) or a lamp type LED shortwave light source (11).

Figure 14:
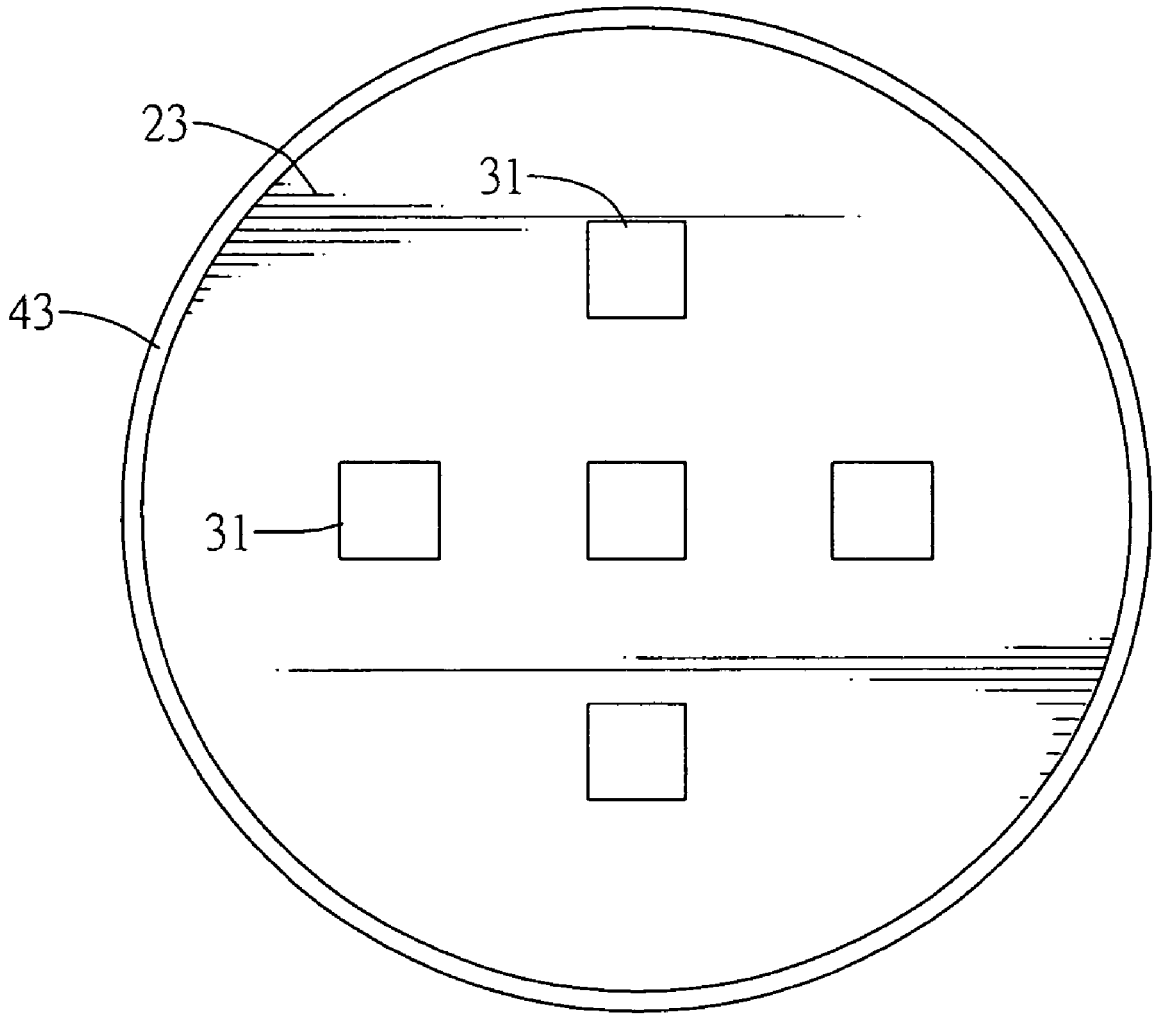
FIG. 14 is a top view of the luminescent assembly in FIG. 13 with multiple shortwave light sources.
Figure 15:
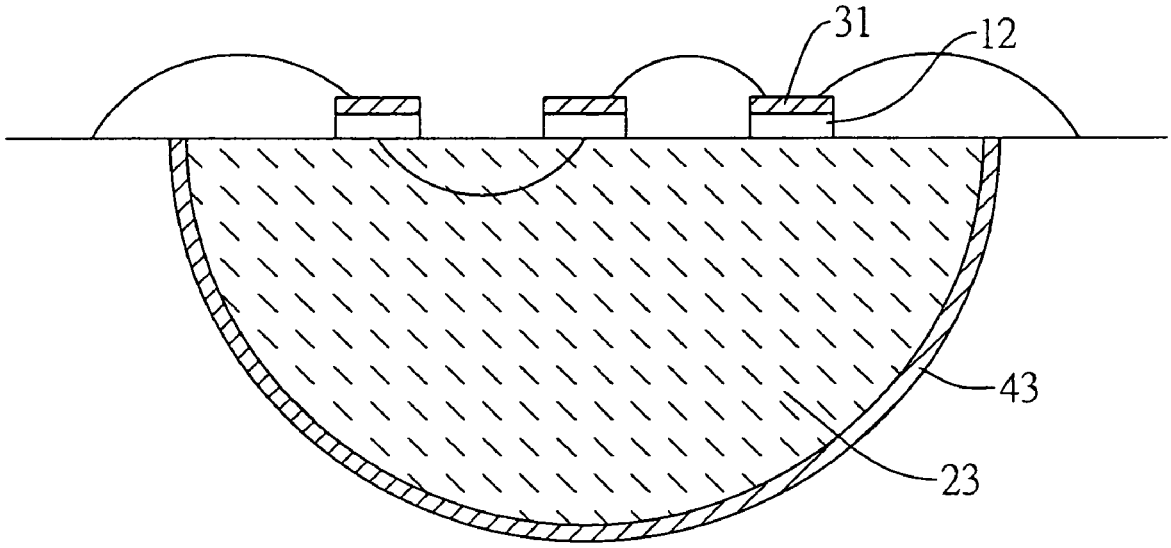
FIG. 15 is an enlarged side view in partial section of the luminescent assembly in FIG. 14.
Figure 16:
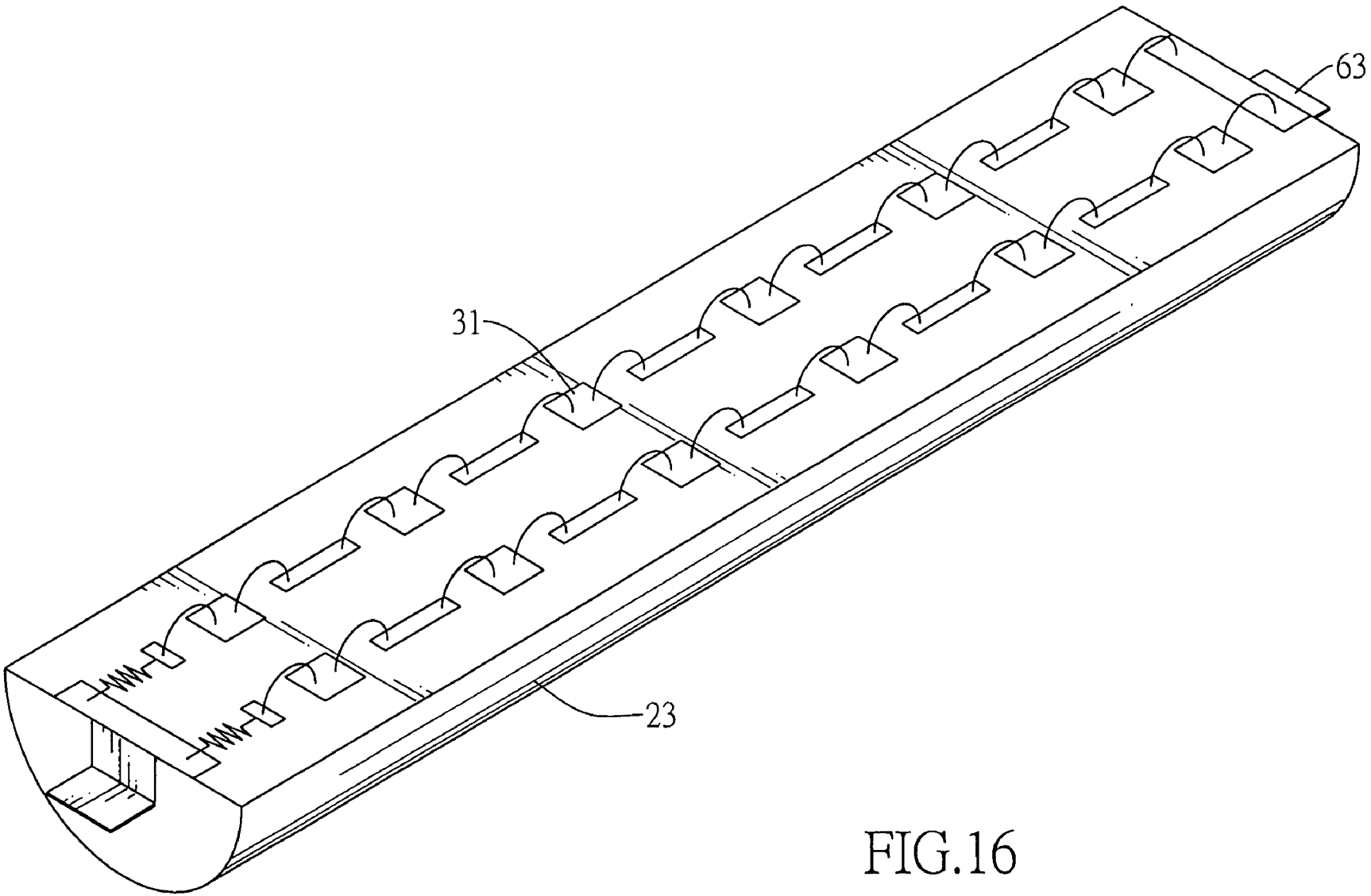
FIG. 16 is an operational perspective view of a shortwave light source in the luminescent assembly in FIG. 14 with multiple diodes.
Figure 17:
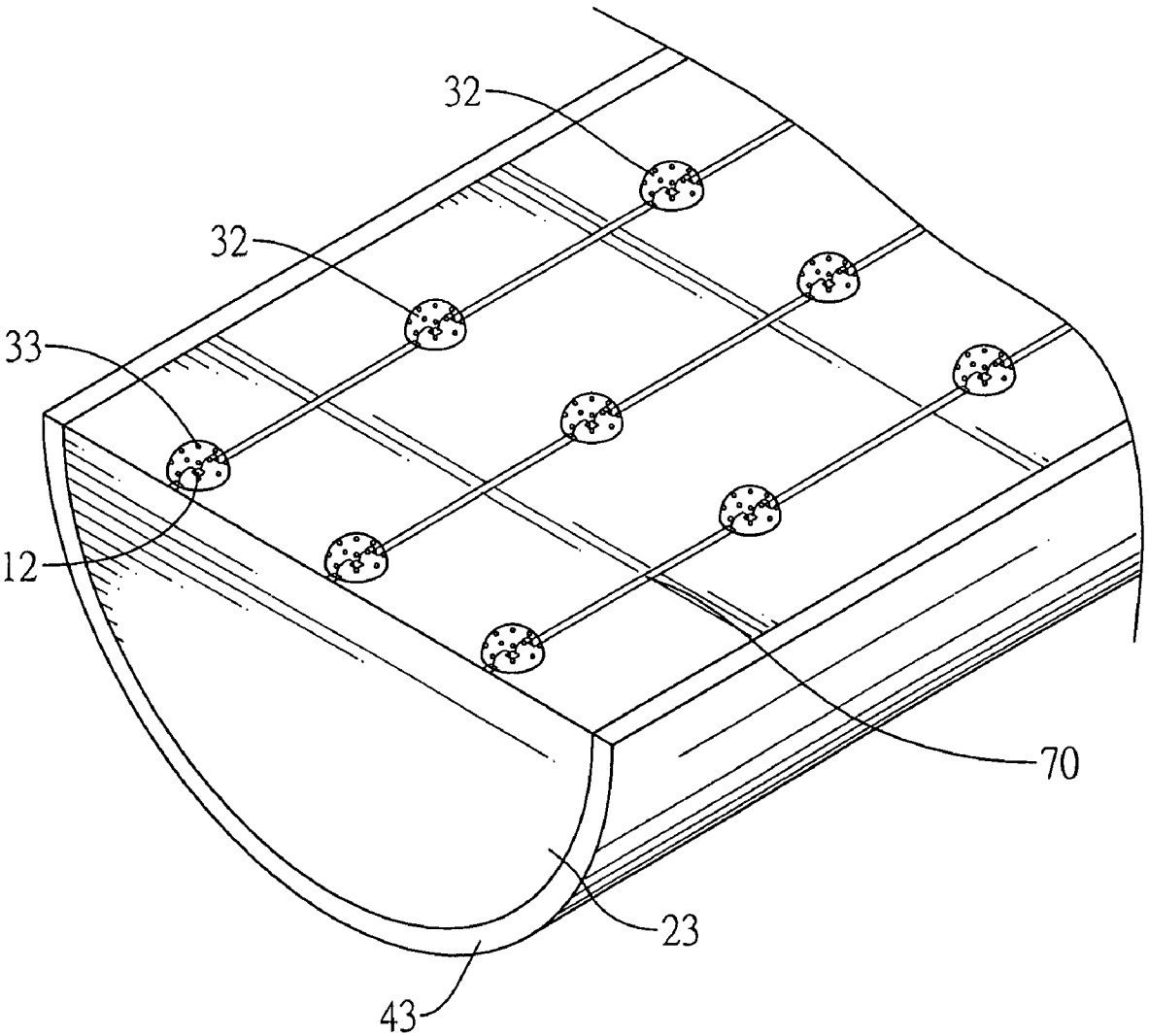
FIG. 17 is an enlarged cross sectional perspective view of the luminescent assembly in FIG. 14 with dome shaped outer covers.
Figure 18:
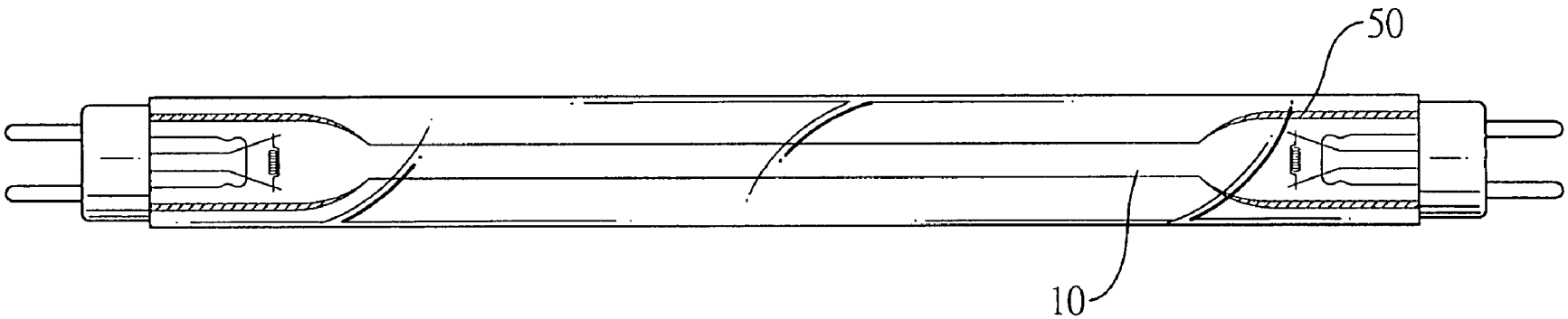
FIG. 18 is a side view in partial section of the luminescent assembly in FIG. 1.
Figure 19:
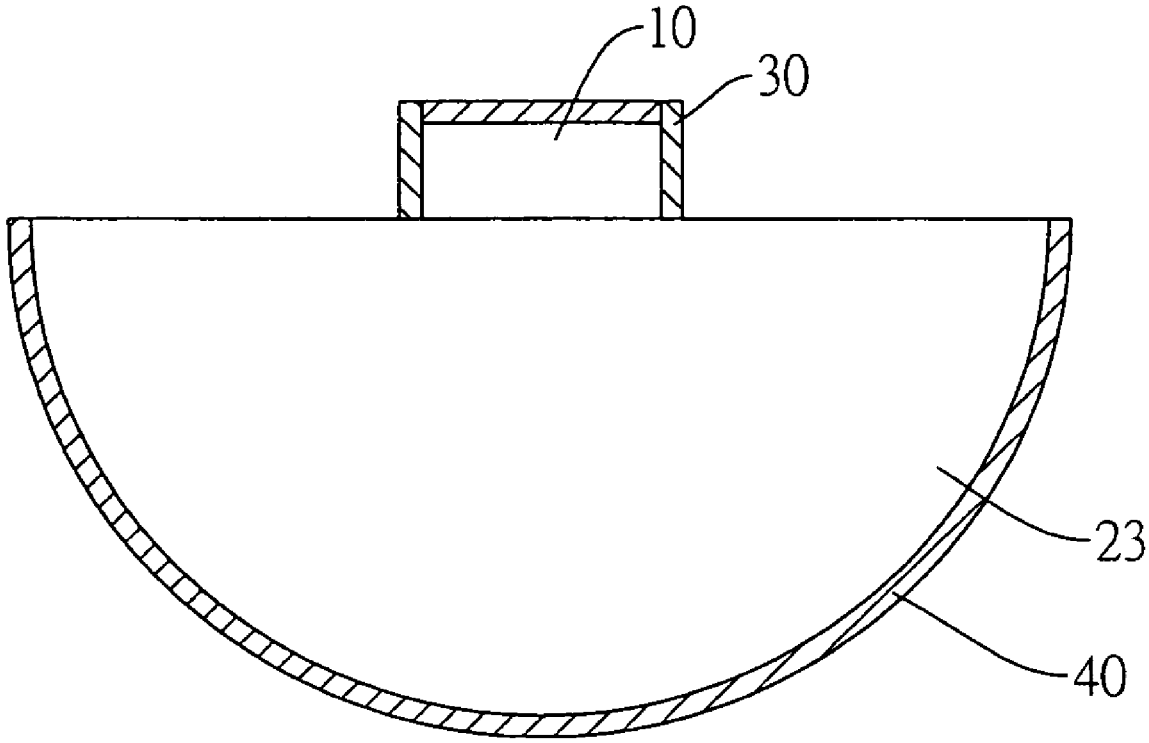
FIG. 19 is a cross sectional end view of a fifth embodiment of a luminescent assembly in accordance with the present invention.
Figure 20:
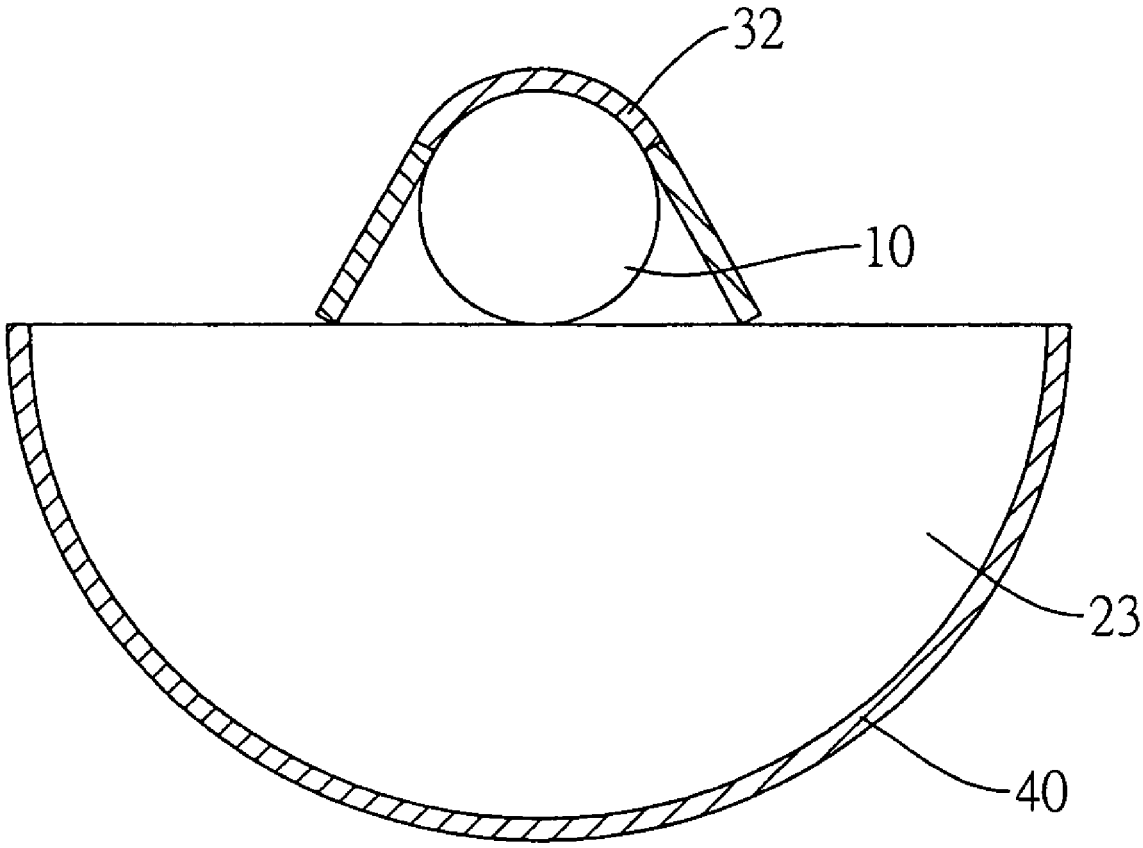
FIG. 20 is a cross sectional end view of the luminescent assembly in FIG. 19 with a dome shaped outer cover.

Wit further reference to FIGS. 14 to 16, the chip or the SMD LED shortwave light source (12) connects to the concave housing (22) by the lead frames (70) and multiple bonding wires or is mounted on the front surface of a transparent substrate housing (23) and emits shortwave light and has a surface, a front and a rear. The rear of the chip or the SMD LED shortwave light source (12) may abut with the front surface of the transparent substrate housing (23).

Each lamp type LED shortwave light source (11) is mounted in the concave housing (22) in the electrical lead or is mounted on the supporting substrate (60), emits shortwave light and further has a front and a rear. The rear abuts and makes electrical contact with the concave housing (22) or the supporting substrate (60).

The chip or SMD LED shortwave light source (12) connects with two electrodes by two bonding wires or by the housing (23) and one bonding wire. The front and the rear of the lamp type LED shortwave light source (11) connect to two electrodes.

The shortwave light cover (30, 31, 32) covers the shortwave light source (10, 11, 12), keeps shortwave light from radiating directly from the shortwave light source (10, 11, 12) out of the luminescent assembly. The shortwave light cover (30, 31, 32) may be a fluorescent/phosphorescent coating and emits visible light and has a front surface and a rear surface. Visible light is emitted from the front surface radiates out from the luminescent assembly. The shortwave light cover (30, 31, 32) may be a reflector to reflect the shortwave light to the housing (20, 21, 22, 23). The shortwave light cover (30, 31, 32) may be the reflector and the fluorescent/phosphorescent coating mounted on part of the reflector. The shortwave light cover (31) is a chip itself-contained reflector may be formed on the surface of the chip when the shortwave light source (11, 12) is a chip. The shortwave light cover (30, 31, 32) may be an outer cover (32) mounted between the shortwave light source (10, 12) and the tubular housing (20) or box housing (21) or mounted on the transparent substrate housing (23). The outer cover (32) have a front to correspond to and cover the front of the shortwave light source (10, 12). The shortwave light cover (32) may further have two sides corresponding to the two sides of the tubular shortwave light source (10). The outer cover (32) may be transparent with the fluorescent/phosphorescent coating mounted on, or with the reflector mounted on, or the reflector, or the fluorescent/phosphorescent coating mounted on the front and the reflector mounted on the two sides or the like.

Figure 11:
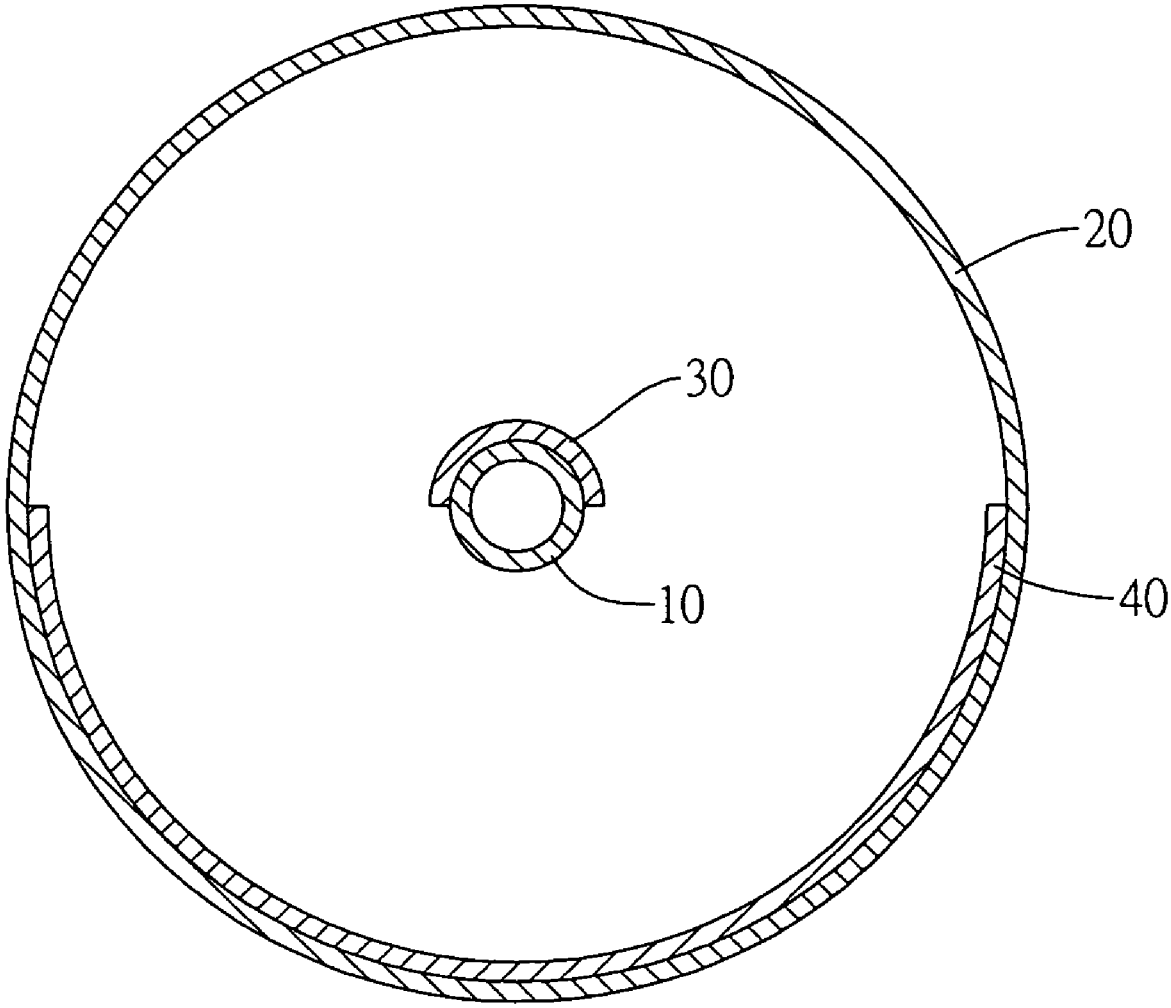
FIG. 11 is a cross sectional view of the luminescent assembly in FIG. 1 with the shortwave light cover outside the shortwave light source.
Figure 12:
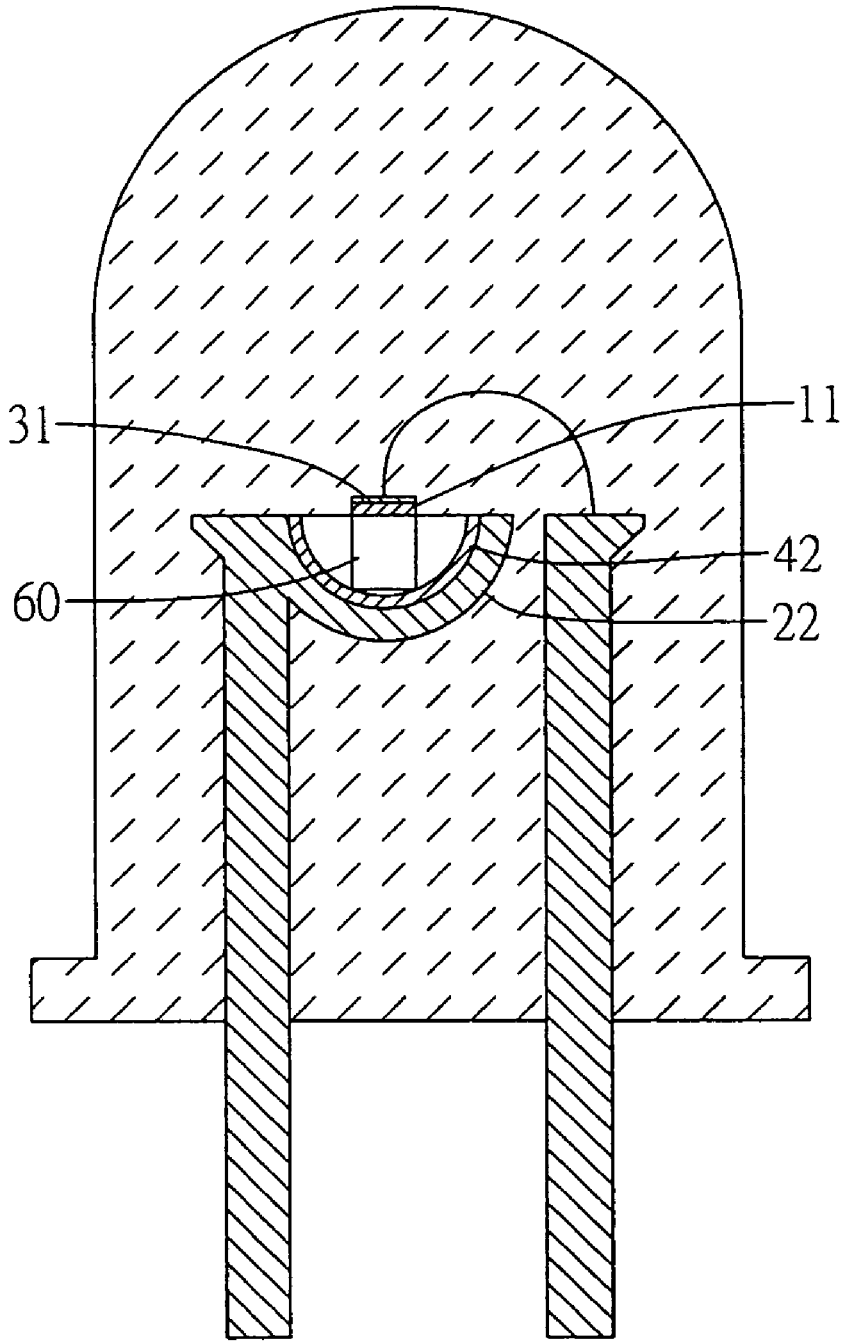
FIG. 12 is a side view in partial section of a third embodiment of a luminescent assembly in accordance with the present invention.
Figure 13:
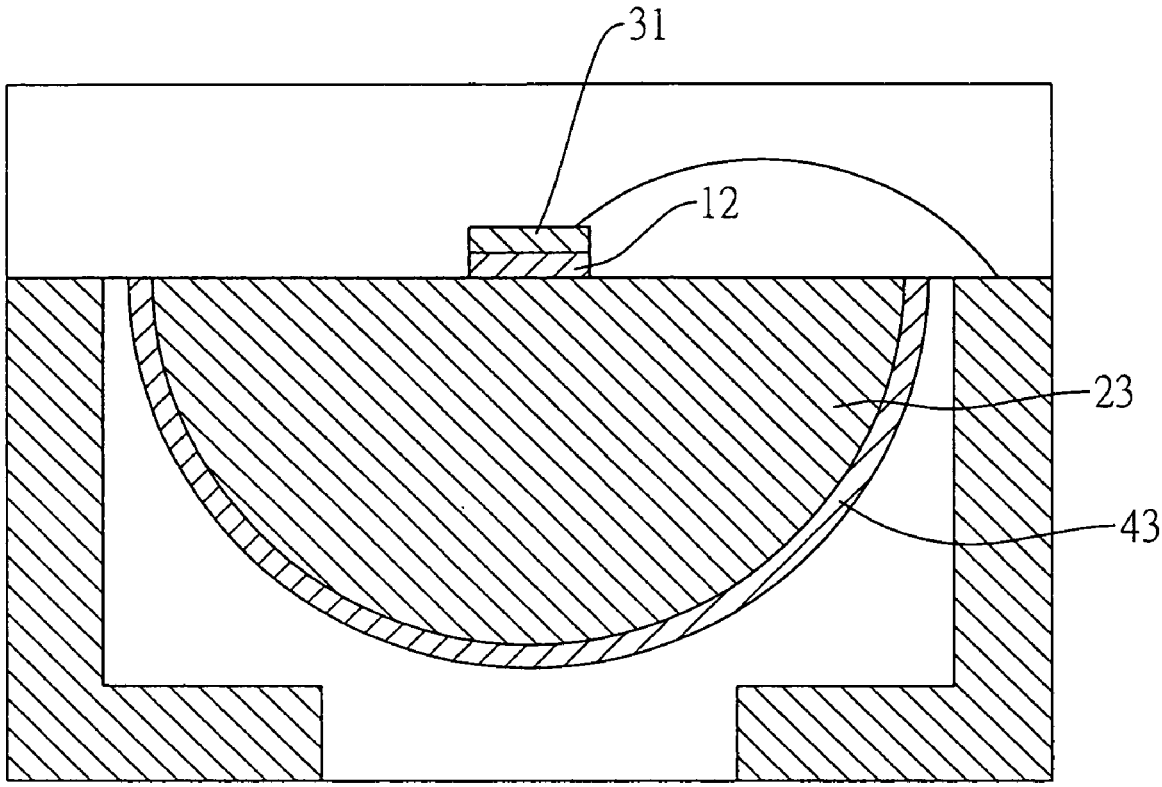
FIG. 13 is a cross sectional side view of a fourth embodiment of a luminescent assembly in accordance with the present invention.

With further reference to FIG. 11, the shortwave light cover (30) may be formed on the inside or outside of the tubular shortwave light source (10).

The shortwave light cover (31) may mounted on the front of the lamp type shortwave light source (11), the chip or the SMD LED shortwave light source (12) and may be an outer cover (32) mounted on the transparent substrate housing (23) and covering the front of the chip or the SMD LED shortwave light source (12). The front of the chip or the SMD LED shortwave light source (12) emits shortwave light to the outer cover (32).

Figure 21:
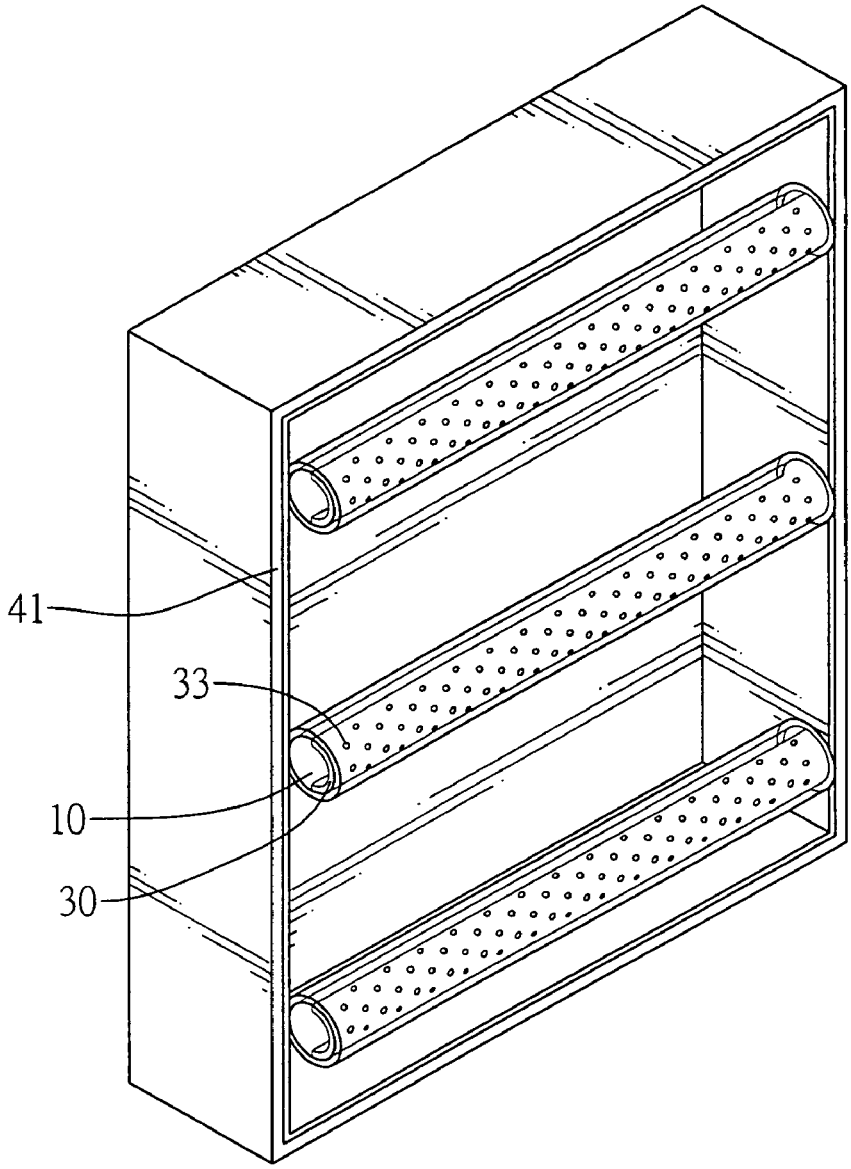
FIG. 21 is a perspective view of the luminescent assembly in FIG. 1 with multiple tubular shortwave light sources and each shortwave light cover being a reflector with multiple holes.
Figure 22:
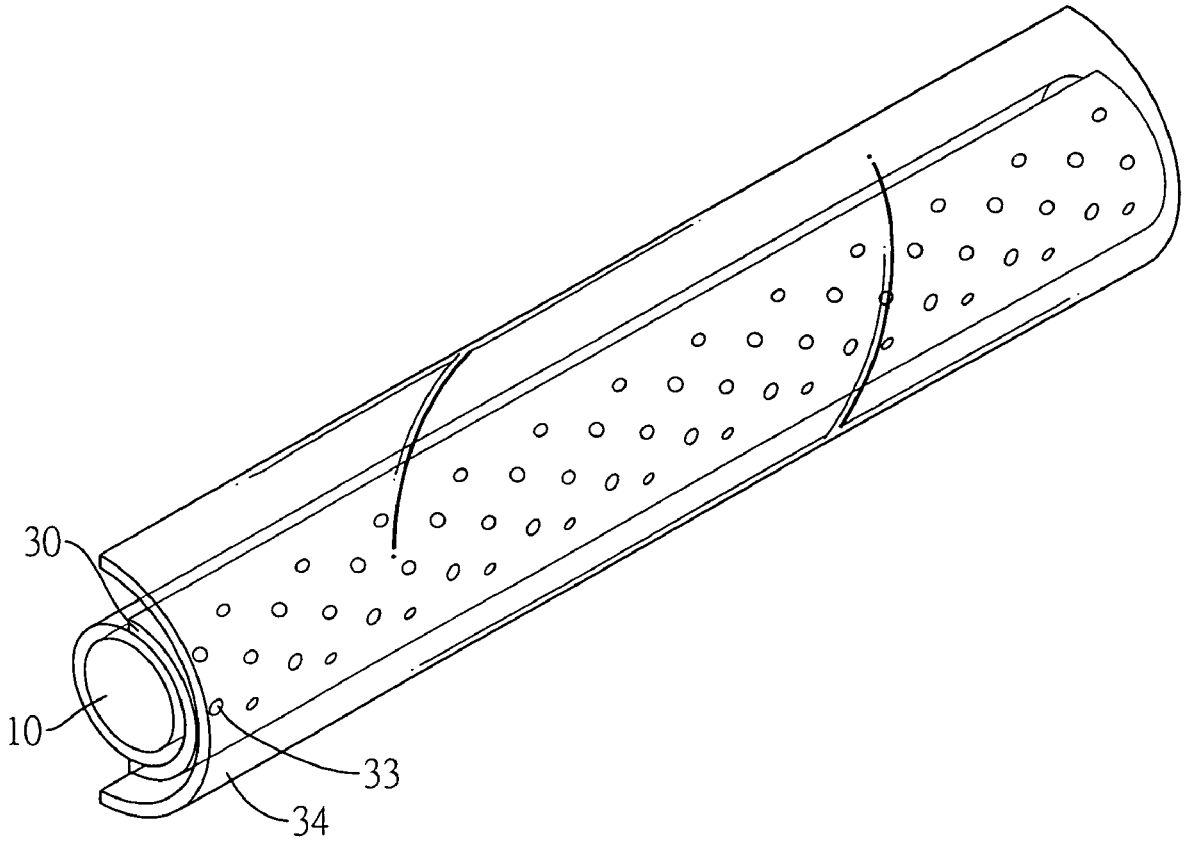
FIG. 22 is a partially perspective view of the luminescent assembly in FIG. 21 showing that the shortwave light cover is a reflector with multiple holes and a coating cover covers the reflector.
Figure 23:
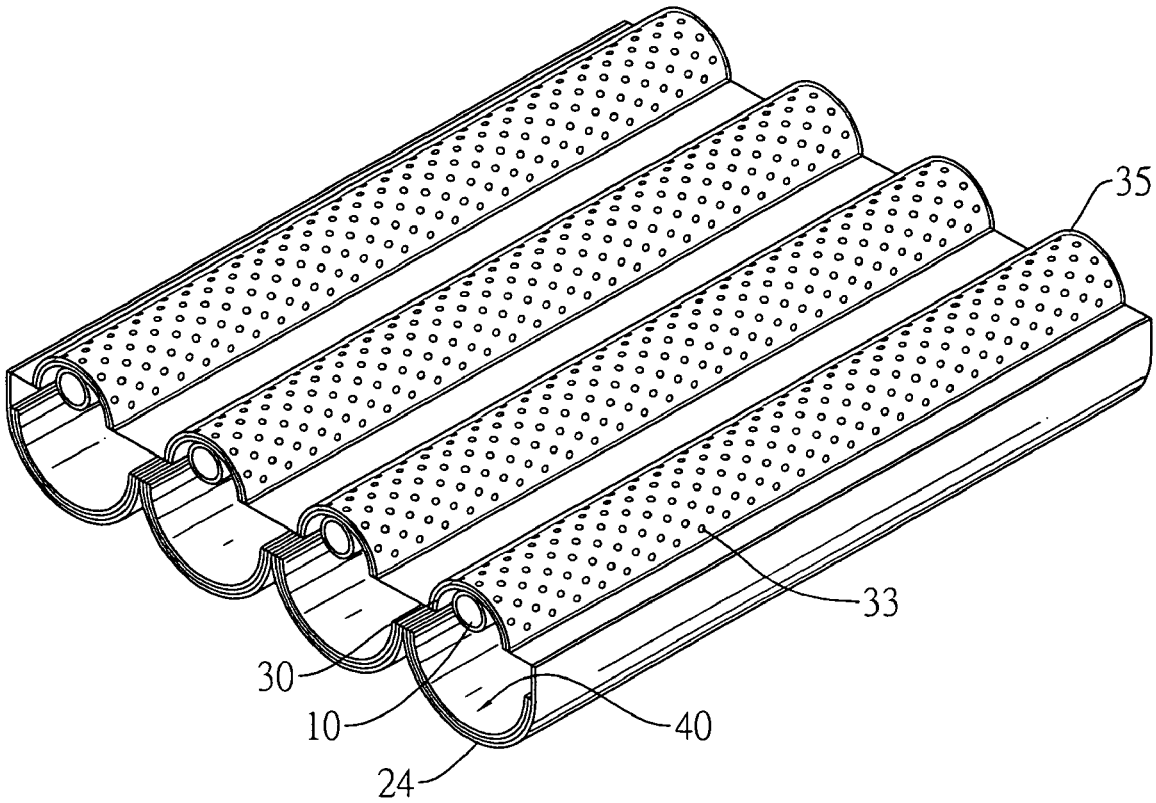
FIG. 23 is a perspective view of a sixth embodiment of a luminescent assembly is accordance with the present invention.
Figure 24:
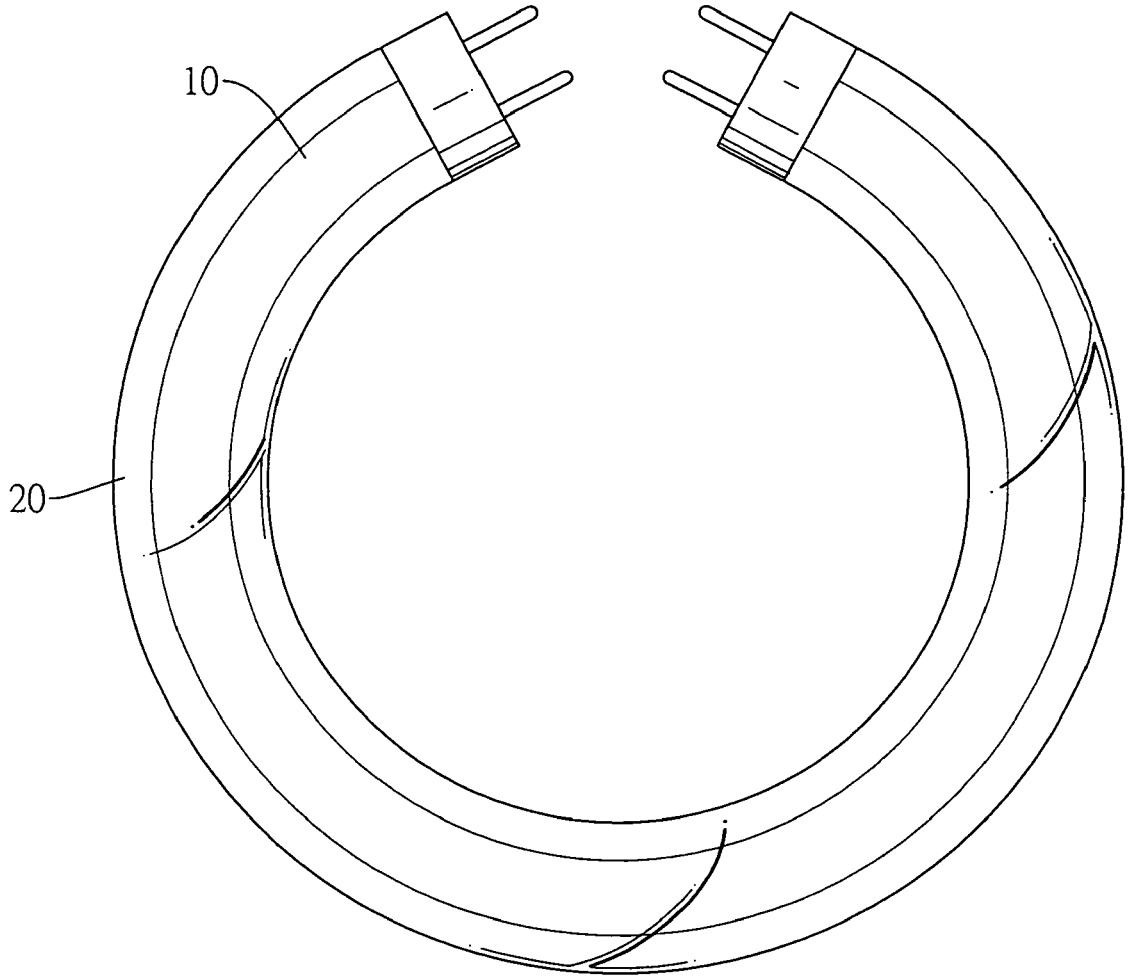
FIG. 24 is a perspective view of the luminescent assembly in FIG. 1 in an annular configuration.

With further reference to FIGS. 21 to 23, the shortwave light cover (30, 31, 32) further comprises a transparent sheet (35) to allow the reflector that has multiple holes (33) to mount on and the fluorescent/phosphorescent coating to fill in the holes (33), so visible light emits through the holes (33) and the shortwave light will not emit directly to people. The holes (33) in the reflector have a density. The shortwave light cover (30, 31, 32) may further have a coating cover (34) having fluorescent/phosphorescent coating mounted on the coating cover when the fluorescent/phosphorescent coating is not filled in the holes (33). The coating cover (34) is mounted out of the reflector or the reflector mounted out of the coating cover (34). Shortwave light emits to the reflector and some shortwave light is reflected by the reflector and some shortwave light passes through the holes (33) filled by the fluorescent/phosphorescent coating or covered by the outer coating cover (34). Because the shortwave light cover (30, 31, 32) near the shortwave light source (10, 11, 12) has stronger shortwave light than far from the shortwave light source (10, 11, 12), so the density of the holes (33) near the shortwave light source (10, 11, 12) is lower than the density of the holes (33) far from the shortwave light source (10, 11, 12). Visible light emitted from the luminous assembly having the shortwave light cover (30, 31, 32) being the reflector with multiple holes (33) is more even than the luminous assembly having the shortwave light cover (30, 31, 32) being the reflector without multiple holes (33).

The electrode shields (50) are formed respectively around the ends of the tubular shortwave light source (10) or the tubular housing (20), hide the at least one electrode to improve the appearance of the luminescent assembly and may be a fluorescent/phosphorescent coating.

The primary visible light source (40, 41, 42, 43) is significantly larger than the shortwave light cover (30, 31, 32), comprises a fluorescent/phosphorescent coating and may further comprise a reflector with the fluorescent/phosphorescent coating mounted on and is coated on rear surface of the housing (20, 21, 22, 23). The primary visible light source (40, 41, 42, 43) is excited by shortwave light from the at least one shortwave light source (10, 11, 12) and may be from the shortwave light cover (30, 31, 32) being the reflector, emits visible light and may reflect visible light emitted from the shortwave light cover (30, 31, 32) being the fluorescent/phosphorescent coating, and has a front surface and a rear surface. The primary visible light source (40) on the tubular housing (20) is mounted on the rear surface of the tubular housing (20), the rear surface and two side surfaces of the box housing (21) or the rear surface of the transparent substrate housing (23). In the LED, the primary visible light source (42) being the fluorescent/phosphorescent coating on the transparent substrate housing (23) is formed on the rear surface of the transparent substrate housing (23) or applies to the concave housing (22). When shortwave light is blue light, that is not harmful to people, the primary visible light source (40, 41, 42, 43) comprises a reflector mounted on the housing (20, 21, 22, 23) and a fluorescent/phosphorescent coating is partially mounted on the reflector, so some blue light is able to reflect by the reflector.

By adjusting the density of the holes (33), people can get an even brightness light source when looking at the luminous assembly from the front of the shortwave light source (10, 11, 12).

The shortwave light absorbing cover (80) is transparent, is opposite to the primary visible light source (40, 41, 42, 43), is mounted on the housing (20, 21, 22, 23) to prevent residual shortwave light from radiating to people. The shortwave light absorbing cover (80) may be a coating, a film sheet or a plate.

The luminescent assembly as described has the following advantages. By adjusting the density of the holes (33), people can get an even brightness visible light when looking at the primary visible light source (40, 41, 42, 43) from front. Visible light emitted from the primary visible light source (40, 41, 42, 43) passes directly out of the luminescent apparatus without having to pass through an intervening cover. Therefore, the visible light is brighter than a conventional luminescent apparatus. Furthermore, all the potentially harmful shortwave light will be transited to visible light or reflected by the shortwave light cover (30, 31, 32) so the luminescent assembly is not a safety hazard to people.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A luminescent assembly with an increased brightness comprising:

a housing having a rear surface;

at least one shortwave light source mounted with the housing for emitting shortwave light and having a front surface facing away from the rear surface of the housing;

at least one shortwave light reflecting cover covering the front surface of the shortwave light source and being coated with a coating so as to reflect shortwave light in a direction toward the rear surface of the housing and to emit visible light; and a primary visible light source comprising a coating formed on the rear surface of the housing to emit visible light and being significant larger than the shortwave light reflecting cover.

2. The luminescent assembly as claimed in claim 1, wherein the at least one shortwave light cover comprises a transparent sheet to allow a reflector that has multiple holes to be mounted on and a fluorescent coating to fill in the holes.

3. The luminescent assembly as claimed in claim 1, wherein the at least one shortwave light cover comprises a transparent sheet to allow a reflector that has multiple holes to be mounted on and a phosphorescent coating to fill in the holes.

4. The luminescent assembly as claimed in claim 1, wherein the at least one shortwave light cover comprises a reflector with multiple holes and a coating cover with a fluorescent coating mounted on to cover the reflector.

5. The luminescent assembly as claimed in claim 1, wherein the at least one shortwave light cover comprises a reflector with multiple holes and a coating cover with a phosphorescent coating mounted on to cover the reflector.

6. The luminescent assembly as claimed in claim 1, wherein the at least one shortwave light reflecting cover is selected from a group consisting of a fluorescent coating, a phosphorescent coating and a reflecting cover.

7. The luminescent assembly as claimed in claim 1, wherein the coating of the primary visible light source is a fluorescent coating.

8. The luminescent assembly as claimed in claim 1, wherein the coating of the primary visible light source is a phosphorescent coating.

9. The luminescent assembly as claimed in claim 1, wherein the primary visible light source further comprises a reflecting cover mounted on the housing and allows the coating to be mounted on the reflecting cover.

10. The luminescent assembly as claimed in claim 1, wherein the housing is a tube and has a rear surface; the at least one shortwave light source comprises a tube mounted in the tubular housing and has a front; at least one end; at least one electrode mounted in the at least one end of the tubular shortwave light source; the at least one shortwave light reflecting cover is mounted on the front of the tubular shortwave light source; and the primary visible light source is formed on the tubular housing and covers rear surface of the tubular housing.

11. The luminescent assembly as claimed in claim 1, wherein the housing is a box and has an open face;

an rear surface; and two side surfaces; and the at least one shortwave light source comprises a tube, is mounted at the open face of the box housing and has a front;

a rear facing to the rear surface of the box housing;

at least one end connecting to the box housing;

at least one electrode mounted in the at least one end of the tubular shortwave light source;

the at least one shortwave light cover mounted on the front of the at least one shortwave light source; and the primary visible light source is formed on the rear surface and the sides of the box housing.

12. The luminescent assembly as claimed in claim 1, wherein the housing is a transparent substrate being solid and has a front surface; and a rear surface;

the at least one shortwave light source comprises a tube mounted on the front surface of the transparent substrate housing and has a front;

a rear connecting to the front surface of the transparent substrate housing;

at least one end;

at least one electrode mounted in the at least one end of the tubular shortwave light source;

the at least one shortwave light cover is mounted on the front of the tubular shortwave light source; and the primary visible light cover is formed on the rear surface of the transparent substrate housing.

13. The luminescent assembly as claimed in claim 1, wherein the housing is a transparent substrate being hollow and has a front surface; and a rear surface;

the at least one shortwave light source comprises a tube, is mounted on the front surface of the transparent substrate housing and has a front;

a rear connecting to the front surface of the transparent substrate housing;

at least one end;

at least one electrode mounted in the at least one end of the tubular shortwave light source;

the at least one shortwave light cover is mounted on the front of the tubular shortwave light source; and the primary visible light cover is formed on the rear surface of the transparent substrate housing.

14. The luminescent assembly as claimed in claim 1, wherein the housing comprises a combination of multiple solid transparent substrates and each transparent substrate has a front surface; and a rear surface;

multiple shortwave light source comprise tubes mounted on the front surfaces of the combination of multiple transparent substrates housing and each tube has a front;

a rear connecting to the front surface of each transparent substrate housing;

at least one end;

at least one electrode mounted in the at least one end of the tubular shortwave light source;

the at least one shortwave light cover is mounted on the front of at least one shortwave light source; and the primary visible light cover is formed on the rear surface of each transparent substrate.

15. The luminescent assembly as claimed in claim 1, wherein the housing comprises a combination of multiple hollow transparent substrates and each transparent substrate has a front surface; and a rear surface;

multiple shortwave light sources comprise tubes mounted on the front surfaces of the combination of multiple transparent substrates housing and each tube has a front;

a rear connecting to the front surface of each transparent substrate;

at least one end;

at least one electrode mounted in the at least one end of the tubular shortwave light source;

the at least one shortwave light cover is mounted on the at least one shortwave light source; and the primary visible light cover is formed on the rear surface of each transparent substrate.

16. The luminescent assembly as claimed in claim 1, wherein the at least one shortwave light source comprises a tube mounted inside the housing and has a front;

two sides;

at least one end;

at least one electrode mounted in the at least one end of the tubular shortwave light source;

the at least one shortwave light cover comprises an outer cover covering the front of the at least one shortwave light source and has a front corresponding and covering the front of the tubular shortwave light source; and two sides corresponding and covering the two sides of the tubular shortwave light source; and the primary visible light source on the housing covers rear surface of the housing.

17. The luminescent assembly as claimed in claim 1, wherein the housing is a transparent substrate being solid and has a front surface; and a rear surface;

the at least one shortwave light source comprises at least one LED chip that emits shortwave light, is mounted on the front surface of the transparent substrate housing and has a front; and a rear mounted on front surface of the transparent substrate housing;

the at least one shortwave light cover is mounted on the at least one chip; and the primary visible light cover is formed on the rear surface of the transparent substrate housing.

18. The luminescent assembly as claimed in claim 1, wherein the housing is a transparent substrate being hollow and has a front surface; and a rear surface;

the at least one shortwave light source comprises at least one LED chip that emits shortwave light, is mounted on the front surface of the transparent substrate housing and has a front; and a rear mounted on front surface of the transparent substrate housing;

the at least one shortwave light cover is mounted on the at least one chip; and the primary visible light cover is formed on the rear surface of the transparent substrate housing.

19. The luminescent assembly as claimed in claim 1, wherein the housing is a transparent substrate being solid and has a front surface; and a rear surface;

the at least one shortwave light source comprises at least one LED chip that emits shortwave light, is mounted on the front surface of the transparent substrate housing and has a front emitted shortwave light; and a rear mounted on the front surface of the transparent substrate housing;

the at least one shortwave light cover comprises an outer cover mounted on the front surface of the transparent substrate housing and covering the front of the chip; and the primary visible light source is formed on the rear surface of the transparent substrate housing.

20. The luminescent assembly as claimed in claim 1, wherein the housing is a transparent substrate being hollow and has a front surface; and a rear surface;

the at least one shortwave light source comprises at least one LED chip that emits shortwave light, is mounted on the front surface of the transparent substrate housing and has a front emitted shortwave light; and a rear mounted on the front surface of the transparent substrate housing;

the at least one shortwave light cover comprises an outer cover mounted on the front surface of the transparent substrate housing and covering the front of the chip; and the primary visible light source is formed on the rear surface of the transparent substrate housing.

21. The luminescent assembly as claimed in claim 1, wherein the housing is a concave substrate and has an open face;

an rear surface; and multiple lead frames formed on the open face of the housing; and the at least one shortwave light source comprises at least one LED chip that emits shortwave light, is mounted on the lead frames of the concave housing, connects to the concave housing by multiple lead frames and has a front emitted shortwave light; and a rear mounted on the lead frames of the transparent substrate housing;

the at least one shortwave light cover comprises an outer cover mounted on the front surface of the transparent substrate housing and covering the front of the chip; and the primary visible light source is formed on the rear surface of the concave housing.

22. The luminescent assembly as claimed in claim 1, wherein the housing is a concave substrate on an electrical lead and has a rear surface; and the at least one shortwave light source comprises at least one LED chip that emits shortwave light, is mounted in the concave housing in the electrical lead and has a front emitted shortwave light; and a rear;

the at least one shortwave light cover is mounted on the front of the at least one shortwave light source; and the primary visible light source is formed on the rear surface of the concave housing.

23. The luminescent assembly as claimed in claim 1, wherein the housing is a concave substrate and having a supporting substrate being transparent and being mounted in the concave housing;

the at least one shortwave light source comprises at least one LED chip that is mounted on the supporting substrate in the concave housing to emit shortwave light and has a front emitted shortwave light; and a rear mounted on the supporting substrate in the concave housing;

the at least one shortwave light cover is mounted on the front of the at least one shortwave light source;

the primary visible light source is formed the concave housing.

24. The luminescent assembly as claimed in claim 1, wherein the shortwave light is ultraviolet light.

25. The luminescent assembly as claimed in claim 1, wherein the shortwave light is blue light.

26. The luminescent assembly as claimed in claim 1, wherein the housing is a tube being straight.

27. The luminescent assembly as claimed in claim 1, wherein the shortwave light source is a tube being straight.

28. The luminescent assembly as claimed in claim 1, wherein the housing is a tube being annular shaped.

29. The luminescent assembly as claimed in claim 1, wherein the shortwave light source is a tube being annular shaped.

30. The luminescent assembly as claimed in claim 1, wherein the housing is a tube being U-shaped.

31. The luminescent assembly as claimed in claim 1, wherein the shortwave light source is a tube being U-shaped.

32. The luminescent assembly as claimed in claim 1, wherein the housing is a tube being helical.

33. The luminescent assembly as claimed in claim 1, wherein the shortwave light source is a tube being helical.

34. The luminescent assembly as claimed in claim 1, wherein the housing is a tube having multiple bends.

35. The luminescent assembly as claimed in claim 1, wherein the shortwave light source is a tube having multiple bends.

36. The luminescent assembly as claimed in claim 1, wherein the shortwave light source is a tube being a circular cross section.

37. The luminescent assembly as claimed in claim 1, wherein the shortwave light source is a tube having a semi-circular cross section.

38. The luminescent assembly as claimed in claim 1, wherein the shortwave light source is a tube being a polygonal cross section.

39. The luminescent assembly as claimed in claim 1, wherein the shortwave light source being a tube made of a quartz glass.

40. The luminescent assembly as claimed in claim 1, wherein the housing being a tube made of a quartz glass.

41. The luminescent assembly as claimed in claim 1, wherein the shortwave light source comprises a tube having at least one electrode and at least one electrode shield formed respectively around the at least one end of the tubular shortwave light source for hiding the electrode.

42. The luminescent assembly as claimed in claim 1, wherein the shortwave light source comprises a tube and the shortwave light reflecting cover is formed inside the tubular shortwave light source.

43. The luminescent assembly as claimed in claim 1, wherein the shortwave light source comprises a tube and the shortwave light reflecting cover is formed outside the tubular shortwave light source.

44. The luminescent assembly as claimed in claim 1 further having a shortwave light absorbing cover opposite to the primary visible light source, mounted on the housing.

45. The luminescent assembly as claimed in claim 1, wherein the at least one shortwave light reflecting cover comprises a fluorescent coating.

46. The luminescent assembly as claimed in claim 45, wherein at least one shortwave light reflecting cover comprises a phosphorescent coating.

* * * * *